United States Patent [19]

Akiya et al.

[11] Patent Number: 5,041,328

[45] Date of Patent: Aug. 20, 1991

[54] RECORDING MEDIUM AND INK JET RECORDING METHOD BY USE THEREOF

[75] Inventors: Takashi Akiya, Yokohama; Mamoru Sakaki, Sagamihara; Megumi Munakata, Atsugi; Ryuichi Arai, Sagamihara, all of Japan

[73] Assignee: Canon Kabushiki Kaisha, Tokyo, Japan

[21] Appl. No.: 137,819

[22] Filed: Dec. 24, 1987

[30] Foreign Application Priority Data

| | | | |
|---|---|---|---|
| Dec. 29, 1986 | [JP] | Japan | 61-310122 |
| Apr. 10, 1987 | [JP] | Japan | 62-8809 |
| Jul. 1, 1987 | [JP] | Japan | 62-162471 |
| Jul. 7, 1987 | [JP] | Japan | 62-167861 |
| Sep. 18, 1987 | [JP] | Japan | 62-232379 |
| Oct. 20, 1987 | [JP] | Japan | 62-265710 |

[51] Int. Cl.[5] ..... B41M 5/00

[52] U.S. Cl. ..... 428/212; 346/135.1; 428/195; 428/304.4; 428/329; 428/331; 428/341; 428/342

[58] Field of Search ..... 346/135.1; 428/195, 428/207, 211, 914, 212, 331, 304.4, 329, 341, 342

[56] References Cited

U.S. PATENT DOCUMENTS

| | | | |
|---|---|---|---|
| 4,440,827 | 4/1984 | Miyamoto et al. | 428/342 |
| 4,446,174 | 5/1984 | Maekawa et al. | 428/195 |
| 4,460,637 | 7/1984 | Miyamoto et al. | 428/212 |
| 4,478,910 | 10/1984 | Oshima et al. | 428/331 |
| 4,554,181 | 11/1985 | Cousin et al. | 428/207 |
| 4,758,461 | 7/1988 | Akiya et al. | 428/195 |

FOREIGN PATENT DOCUMENTS

| | | | |
|---|---|---|---|
| 0174859 | 3/1986 | European Pat. Off. | 428/195 |
| 0218956 | 4/1987 | European Pat. Off. | 428/195 |
| 2088777A | 6/1982 | United Kingdom | 428/195 |

OTHER PUBLICATIONS

Abstract Bulletin of the Institute of Paper Chemistry, vol. 57, No. 6, (Dec. 1986), p. 890, abstract nos. 7999 and 8000.

Abstract Bulletin of the Institute of Paper Chemistry, vol. 57, No. 7, (Jan. 1987), p. 1041, abstract nos. 9391 through 9393.

Proceedings of the S.I.D., vol. 25, No. 1, 1984, pp. 65-70, (Los Angeles) C. W. Jaeger, et al., "The Influence of Ink/Media Interactions on Copy Quality in Ink-Jet Printing".

*Primary Examiner*—Pamela R. Schwartz

*Attorney, Agent, or Firm*—Fitzpatrick, Cella, Harper & Scinto

[57] ABSTRACT

A recording medium comprises a substrate and a ink receiving layer containing a silicon-containing type colorant and a binder provided on said substrate, wherein the recording medium exhibits discoloration $\Delta E^*ab$ of C. I. Food Black 2 being 20 or less according to the ozone test.

40 Claims, No Drawings

RECORDING MEDIUM AND INK JET RECORDING METHOD BY USE THEREOF

BACKGROUND OF THE INVENTION

1. Field of the Invention

This invention relates to a recording medium which can be suitably used for an ink jet recording method and particularly to a recording medium excellent in absorptivity, color forming characteristic of aqueous ink, and excellent in print quality of the recorded image obtained.

Further, the present invention relates to a recording method which can provide a recorded image excellent in storability with little indoor discoloration of the image, and to an ink jet recording method which can provide the above recorded image.

2. Related Background Art

As the recording medium for ink jet recording of the prior art, there have been known: for example, (1) one formed into a filter paper or a blotting paper by sheet making of a paper in general composed mainly of pulp to a low sizing degree;

(2) one having a coated layer containing a pigment which is porous and capable of adsorbing colored components in the ink and which shows large oil absorption, such as silica or zeolite, on a substrate as disclosed in Japanese Laid-open Patent Application No. 148585/1981.

While the recording medium (1) can be prepared at low cost and its ink absorptivity is excellent, the ink is penetrated deep into the fiber layer of the paper, whereby the color forming characteristic of the pigment in the ink is poor. Also, since the ink is absorbed along the fibers on the paper surface, a phenomenon called feathering occurs, whereby a dot does not become circular, but ragged, and the drawback is that resolution is lowered, failing to give an image of good quality.

Thus, the papers of such non-coated type have been utilized exclusively for uses with relatively lower resolution, not requiring necessarily images of high density, such as the terminals of monochromatic recording, and personal computers.

In the recording medium (2), since its ink absorbing layer is porous and uniform, one having adequate ink absorptivity as well as excellent dot shape and resolution can be obtained.

However, in a recording system which requires a color image of higher quality and higher resolution, the following requirements are further demanded also for the recording medium:

(1) it should have an ink absorbing capacity such that a dot will not flow out and will not be expanded more than is necessary even if ink droplets of multi-color may be superposed on the same spot;

(2) it should have an ink absorbing speed, and an ink dry time characteristic such that the ink droplets will not feather if smeared immediately after attachment;

(3) a recording agent in an ink received in an ink absorbing layer should be excellent in color forming characteristic;

(4) ink dots attached should be smooth at their peripheries and have a shape approximate to true sphere, etc.; and in addition, storability such as water resistance, light resistance of the recorded image obtained is required.

In U.S. Pat. No. 4,478,910 and Japanese Laid-Open Patent Application No. 230787/1984, in view of the physical properties of a pigment in an ink absorbing layer in order to obtain more excellent color forming characteristic of a dye, there is introduced a recording medium by use of silica having a specific surface area of 200 $m^2/g$ or more or silica having an acid value of 240 mg.mol/kg or more.

Also, in Japanese Laid-open Patent Application No. 84992/1981, as a method for strengthening water resistance of an ink jet recorded image, there is described a method in which recording is performed by use of acidic/direct dyes on a recording medium having a polycationic polymeric electrolyte contained in its ink absorbing layer so that these dyes attached on the ink absorbing layer will not be flowed out even when the recorded image is dipped into water.

Light resistance of the image is concerned with the problem of discoloration and fading of the recorded image by photolysis of the dye, and it has been considered as the problem of the dye itself to date, but it has become known that a water-resistant agent as mentioned above, particularly a polycationic substance has promoted photolysis of the dye. For example, Japanese Laid-open Patent Applications Nos. 11389/1985 and 49990/1985 describe a recording medium containing a polycation with little promotion of photolysis of a dye, and also Japanese Laid-open Patent Application No. 72785/1985 describes a recording medium containing a polycation together with a UV-absorber and an antioxidant.

However, recently, a new problem concerning storability of image, particularly indoor discoloration of recorded image other than such water resistance and light resistance is becoming highlighted. The problem of indoor discoloration has been considered to be a problem caused by decomposition of a dye, but cannot be solved by the recording media known in the art.

Fading of the image, which is a problem in the prior art, is a phenomenon caused by decomposition of a dye within a recorded image by visible light, UV-ray and it will not occur at the portion which is not directly irradiated with sunlight. Also, in the place which is irradiated with sunlight, fading occurs also in an image recorded on a recording medium of any type such as so-called normal ppc paper or the recording medium (1) and (2) as mentioned above, and it has been known that fading is promoted when the recording medium contains a polycationic substance.

On the other hand, indoor discoloration as herein mentioned proceeds even when a recording medium is not directly irradiated with sunlight, and will not occur on a normal paper and a non-coated paper. Also, discoloration of an image occurs without any appreciable effect even when a polycation with little influence on light resistance as described above may be employed or even when a UV-ray absorber may be incorporated.

Fading as herein mentioned refers to the phenomenon in which chromaticity of a printed matter is lowered, while discoloration refers to a phenomenon in which chromaticity is not lowered but hue is primarily changed.

As described above, the problem of indoor discoloration as mentioned in the present invention is a phenomenon inherent in a coated paper having an ink absorbing layer, but neither its clear cause nor countermeasure has been known yet.

In addition, there is posed the problem that when such coated paper not printed is stored in a binder made of polypropylene or polyethylene for one to several months, discoloration to yellow occurs at the periphery of the paper and bringing the paper into contact with an adhesive tape or a rubber roller of a printer results in discoloration to yellow around the contact portion.

Similarly to indoor discoloration, the problem of such discoloration to yellow is inherent in the coated paper (such problem is posed in a non-coated paper). The problem has not been solved yet.

SUMMARY OF THE INVENTION

Accordingly, an object of the present invention is to provide a recording medium which can give a recorded image with good storability, particularly with little deterioration by indoor discoloration, and a recording method capable of forming such image.

Another object of the present invention is to provide a recording medium which is excellent in soil resistance, and, which shows no discoloration to yellow thereof upon being stored in a file or a binder.

A further object of the present invention is to provide a recording medium which is excellent in ink absorptivity and the color forming characteristic of dye, and can give a recorded image of high quality and high resolution.

The above objects and other objects of the present invention can be accomplished by the present invention as specified below.

In one aspect, the present invention provides a recording medium, comprising a substrate and an ink receiving layer containing a silicon-containing type pigment and a binder provided on said substrate, wherein the recording medium exhibits discoloration $\Delta E^*ab$ of C.I. Food Black 2 being 20 or less according to the ozone test.

The present invention also provides a recording medium, comprising a substrate and an ink receiving layer containing a silicon-containing type pigment with a specific surface area in the range of 10 to 200 $m^2/g$, aluminum oxide particles and a binder provided on said substrate, wherein the recording medium exhibits discoloration $\Delta E^*ab$ of C.I. Food Black 2 being 20 or less according to the ozone test.

According to the present invention, there is also provided a recording medium, comprising a substrate and an ink-receiving layer comprising an upper layer containing a silicon-containing type pigment, aluminum oxide and a binder and an under layer containing a pigment with greater particle size than the above pigment, wherein the recording medium exhibits discoloration $\Delta E^*ab$ of C.I. Food Black 2 being 20 or less according to the ozone test.

Further, the present invention also provides a recording medium, comprising a substrate and an ink receiving layer containing a silicon-containing type pigment subjected to the surface treatment with one or a mixture of two or more selected from soaps, hydroxides, salts or oxides of metals selected from the group consisting of K, Ca, Mg, Al, Zn, Ba, Sr and Sn and a binder provided on said substrate, wherein the recording medium exhibits discoloration $\Delta E^*ab$ of C.I. Food Black 2 being 20 or less according to the ozone test.

In another aspect of the present invention, there is also provided a recording method, which comprises imparting ink droplets onto a recording medium, said ink containing a water-soluble dye, and said recording medium having an ink receiving layer containing a silicon-containing type pigment and a binder, wherein the recording medium exhibits discoloration $\Delta E^*ab$ of C.I. Food Black 2 being 20 or less according to the ozone test.

DETAILED DESCRIPTION OF THE PREFERRED EMBODIMENTS

The present inventors have made enumerous investigations on indoor discoloration, and consequently reached the following presumptions, namely:

(1) indoor discoloration occurs as a result of dye decomposition with light and oxygen;

(2) an ink receiving layer containing a pigment and a binder (hereinafter called a coated layer) exhibits catalytic action for this phenomenon, particularly the coated paper excellent in ink jet recording adaptability exhibits strong action, for the following reasons, namely:

(1) indoor discoloration is not generated in non-coated paper, but generated only in a coated paper having a coated layer, occurring particularly in a coated paper excellent in ink jet recording characteristics such as the color forming characteristic of a recording agent and ink absorptivity;

(2) while fading occurs under irradiation with strong light such as sunlight, discoloration occurs under indoor discoloration conditions, which may be considered to be due to the difference in the decomposing mechanism of a dye as a recording agent;

(3) the above tendencies of (1) and (2) will not change even if the recording agent employed may be changed for example to an acidic dye, a basic dye, a direct dye or a dye for food.

On the basis of such presumptions, the ozone test as described below as devised as a method for measuring a catalytic activity of a coated layer for indoor discoloration.

The ozone test may be considered to be a method for expressing the catalytic activity of a coated layer when a dye is decomposed with oxygen, which is a method for expressing the novel physical property which could not be measured according to a variety of methods known in the art.

The ozone test is practiced according to the following procedure in the present invention.

(a) Preparation of test sample:

(1) As a test solution, a solution having 2 parts by weight of C.I. Food Black 2 dissolved as a dye in a solvent comprising 70 parts by weight of deionized water and 30 parts by weight of diethylene glycol is used.

(2) The above test solution is applied to a coated layer of a proportion of 0.4 $\mu l$ to 0.5 $\mu l/cm^2$. As a method for the application of the test solution, there may be employed the method in which the solution is directly attached as the droplets by a fountain pen filler or a pipette, the method in which ink is transferred by use of a stamp, etc., the method in which ink is applied by use of a bar coater, etc., and the method in which ink is attached as small droplets by use of the ink jet recording system, etc.

(b) Test conditions:

(1) With the test tank being intercepted from light, fresh ozone is constantly fed within the tank from the outside thereof, and set so that its concentration may be maintained constantly in the range of $0.1 \pm 0.05$ vol. %.

Also, the air inside of the tank is set so as to be circulated constantly by convection by means of a fan.

(2) The environmental conditions within the tank are set so that the temperature may be maintained in the range of 20° C.±2° C., and the humidity in the range of 65%±3% RH. For further making the absorbed water content within the test sample constant after completion of evaporation of volatiles in the ink, the test sample is used after storage under the above environment for 2 days after preparation.

(3) After set under the conditions of (1) and (2), the sample is exposed to ozone in the test tank for 15 minutes.

(c) Determination of measured value:

(1) The color difference ΔE*ab of the test sample between before and after the ozone exposure in the above test tank for 15 minutes is determined according to JIS Z 8730, and defined as the discoloration ΔE*ab of C.I. Food Black 2.

By use of a recording medium with a color difference (ΔE*ab) of the test sample obtained of 20 or less measured according to the ozone test as described above, the recording medium which can provide an image without any indoor discoloration as intended by the present invention can be obtained.

That the discoloration of C.I. Food Black 2 by the ozone test is over 20 is not preferably because the effect for indoor discoloration is poor. More preferably, the discoloration may be 10 or less.

C.I. Food Black 2 has the function of an indicator similar to a pH indicator or a redox indicator, and makes it possible to evaluate and measure the catalytic activity in the ozone test.

C.I. Food Black as herein mentioned is a commerically available dye represented by the formula shown below:

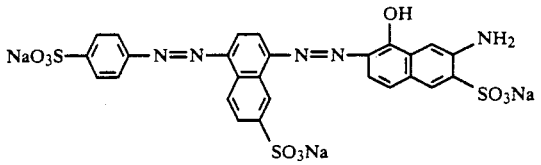

and it is readily available from the market.

C.I. Food Black 2 to be used in the present invention has a purity of 90% or higher. In general, commercially available dye has a purity of about 50 to 60%, containing much inorganic salts, particularly NaCl and $Na_2SO_4$, etc. as impurities. If this is used as such, the effect of C.I. Food Black 2 as the indicator is lowered and further the influence by impurities is included in the test result. For this reason, C.I. Food Black 2 as herein mentioned is purified to enhance its purity to 90% or higher, with the concentration of NaCl and $Na_2SO_4$ being reduced to 1% or less. As the purification method in this case, any of the methods known in the art can be used. As such method, there may be included the method in which the dye is salted out with sodium sulfate, then dissolved in a solvent and filtered; the treatment method with a cation exchange resin technique; the aeration method; the agglomeration precipitation method by use of an agglomerating agent; the filtration method; the electrolytic method; etc.

It is well known in the art that a dye is decomposed with oxygen, as, for example, literature such as J. Soc. Dyers. Color, Vol. 100 (1984), No. 4, P. 125 to 127 (M. Matsui et al).

However, in a non-coated paper, no remarkable discoloration occurs even when the ozone test may be practiced, while remarkable discoloration occurs in a coated paper. Therefore it may be considered that the coated layer plays some catalytic action for indoor discoloration. Also, decomposition of a dye with ozone may be considered to be greatly varied depending on, for example, pH, ionic strength, surrounding environment, adsorbed situation of the dye in the coated layer such as Van der Waals force, hydrogen bonding, and it may be estimated that decomposition of the dye will be directed toward suppression, if ozone is decomposed before attacking the dye or the dye is absorbed by the coated layer so as to be protected from attack.

The recording medium of the present invention with the discoloration of C.I. Food Black 2 being 20 or less according to the ozone test may be also considered to be a recording medium having such a special coated layer.

On the other hand, the ozone concentration in practically accessible air is several ppm, with its lethal amount being 50 ppm, and therefore it can be hardly thought that only ozone contributes directly to indoor discoloration. Even if oxygen molecules in general may contribute to such discoloration, the decomposition mechanism by oxygen molecules is different from that by ozone because oxygen of oxygen molecules in general is in the triplet state while oxygen of ozone in singlet state. Thus, it may be estimated to be difficult to connect the results of the ozone test directly with indoor discoloration.

Having introduced above some presumptions about the relationship between the ozone test and indoor discoloration, it is not relevant to the present invention at all whether these presumptions are correct or not.

Additionally, it has been found that even when the recording medium of the present invention is stored in a file or a binder made of polypropylene or polyethylene for one to several months, coloration (discoloration to yellow) of a white portion as observed in a conventional coated paper does not occur. According to the present inventors' presumptions, such discoloration to yellow may be considered to occur on the ground that an antioxidative agent contained in polypropylene or polyethylene is adsorbed by a porous pigment for forming a coated layer and is oxidized on the coated paper, whereby the coated layer is colored to yellow. Most of products made of polypropylene or polyethylene contains as an addust an antioxidative agent such as BHT which has a phenol group in its molecular structure. It has been known that such phenolic antioxidative agent is colored to yellow by oxidation.

Discoloration to yellow as well as indoor coloration is a phenomenon inherent only in a coated paper and is considered to be promoted by a catalytic property of a coated layer.

Thus, it has been found that a recording medium having a particular coated layer as in the present invention.

According to the knowledge of the present inventors, the recording medium having a coated layer with the discoloration ΔE*ab of C.I. Food Black 2 of 20 or less according to the ozone test is free from any indoor discoloration even when attached on the wall in office or home for one to several months or stored in a drawer of a desk, and is also free from discoloration to yellow if stored in a file or a binder for one to several months and is also excellent in ink jet recording adaptability such as ink absorptivity and the color forming characteristic of a recording agent, etc. as the recording medium having a coated layer.

In the following, a description is provided for a preferable construction for obtaining the recording medium of the present invention. The recording medium obtained must have the discoloration ΔE*ab of C.I. Food Black 2 being 20 or less according to the above ozone test, as a matter of course.

The substrate to be used in the recording medium of the present invention may include, for example, papers, synthetic papers, plastic films, and particularly a paper with a basis weight ranging from 50 to 250 g/m$^2$ and a Stockigt sizing degree of 0 to 100 sec. is suitable. A paper with a basis weight of less than 50 g/m$^2$ does not have firmness and involves a problem in paper feeding and discharging characteristic in printers. On the other hand, if the basis weight exceeds 250 g/m$^2$, there is the problem that powder drop-off of the coated layer will become excessive. If the sizing degree of the paper exceeds 100 sec., adhesive force between the coated layer and the base paper will be lowered, whereby powder drop-off will similarly occur.

The paper to be used in the present invention is a sheet containing a fibrous material and, if necessary, a filler. Any of the papers prepared by sheet-making in the range as specified above with an appropriate sizing agent according to an acidic or neutral sheet making method known in the art can be used.

The fibrous material constituting the above paper to be used in the present invention is composed mainly of a wood pulp, typically LBKP and NBKP, but it may be mixed with various synthetic fibers, glass fibers, etc., if desired.

The coated layer is formed on the above substrate by use of a coating liquid prepared by mixing a pigment and a binder, and further various additives, if necessary.

As preferable embodiments for forming the coated layer according to the present invention, there may be included:

(1) the embodiment in which a silicon-containing type pigment and aluminum oxide are used in combination;

(2) the embodiment in which an upper layer containing a silicon-containing type pigment used in the above embodiment (1) and an under layer containing a pigment with a greater secondary particle size than the above pigment are provided;

(3) the embodiment in which a silicon-containing type pigment subjected to the surface treatment with one or a mixture of two or more of soaps, hydroxides, salts or oxides of metals selected from the group consisting of Na, K, Ca, Mg, Al, Zn, Ba, Sr and Sn is incorporated;

(4) the embodiment in which a silicon-containing pigment subjected to thermal treatment at a high temperature of 400° C. or higher is incorporated, etc.

In addition, the ratio of a pigment to a binder in an ink-receiving layer comprising mainly such pigment is preferably 1/3–5/1, and is more preferably 1/2–3/1 when the ink-receiving layer is a monolayer. The ratio range is such that the coated layer may become porous. If the ratio is less than 1/3 (the amount of the binder is too large), porosity will be lowered, resulting in lowering of ink absorptivity. On the other hand, if the ratio exceeds 5/1 (the amount of the colorant is too large), powder drop off in the coated layer will become remarkable, in some cases, resulting in that indoor discoloration, discoloration to yellow, etc., become outstanding even when the above preferable pigment is used.

As the silicon-containing pigment to be used in the embodiment (1), (a) those with low specific surface area, and (b) those with high pH of the pigment itself, etc. may be suitable. Specific examples of (a) with suitable range may be pigments having a specific surface area according to the BET method in the range of 10 to 200 m$^2$/g, preferably 10 to 100 m$_2$/g. As such pigments, silica, synthetic silicate, silicate mineral, etc. are preferred with respect to the dye color forming characteristic. No such pigment has been generally used in the coated paper for ink jet, but they are commercially sold for use in paints or agricultural medicines, and pigments of various grades are readily available. If the specific surface area exceeds 200 m$^2$/g, indoor discoloration occurs remarkably. On the other hand, although the catalytic activity is lowered as the specific surface area is smaller, a specific surface area smaller than 10 m$^2$/g will result undesirably in lowering of the color forming characteristic of the recording agent.

As the above pigment (b), one with its pH of 7 or higher may be suitably used, more preferably one with pH of 8 or higher.

In the present invention pH of the pigment refers to the pH when measured by sampling 100 ml of ion-exchanged water (pH 5.8 to 6.4) in a beaker of 200 cc, adding 10 g of a pigment thereinto, stirring the mixture with a stirrer for 5 minutes and measuring the pH by means of a pH meter under the state where the pigment is suspended. Ordinarily, the pigment of the silica type has a pH of about 5.5 to 6.5 depending on the manufacturing method. For example, the silica produced by the dry process becomes weakly acidic due to the minutely adsorbed HCl by-produced.

As the method for making a pigment having a pH of 7 or higher, there are:

(i) the method for producing silica by the reaction between sodium silicate and a salt in an aqueous solution, wherein pH is enhanced by maintaining higher the concentrations of basic oxide and unreacted salt during purification of the silica by salting out;

(ii) the method in which the silanol groups on the surface of a pigment are coated in the form of salt by adding metal salt or metal soap of Mg, Ba, Zn, etc. into a suspension of a pigment such as purified silica, etc.;

(iii) the method in which a basic oxide such as MgO, CaO, BaO, etc. is incorporated in the crystal structure of the pigment; etc. According to these methods, a silicon-containing type pigment with a pH of 7 or higher can be obtained.

When a silicon-containing pigment with a pH less than 7 is used, a recorded image obtained is subjected to great discoloration and fading, and particularly remarkable indoor discoloration. The cause is not clear, but it may be considered that the dye (particularly the azo type pigment) absorbed onto the pigment may be oxidized with oxygen in the air to become a decomposed product and effect discoloration, namely the active sites on the pigment surfaces promote catalytically the oxidative decomposition of the dye. This catalytic action is greatly changed depending on the pH of the pigment, and promotes oxidative decomposition at less than pH 7, while the catalytic action is lowered at pH 7 or higher to become inactive, whereby discoloration or brown discoloration of a black dye may be considered to be prevented. In this case, a suitable pigment has a specific surface area in the range of 10 to 650 $m^2/g$, more preferably 10 to 200 $m^2/g$.

However, while the recording medium by use of such pigment may improve in indoor discoloration, the color forming characteristic of the dye including the pigment according to the method (i) is not necessarily satisfactory, and it is impossible to satisfy both of the indoor discoloration inhibiting effect and the image density only be use of these silica type pigments.

In the embodiment (1), the above problem is solved by using in combination the above silicon-containing pigment and aluminum oxide. More specifically, for the first time by using in combination the above silicon-containing pigment and aluminum oxide, further excellent dye color forming characteristic can be obtained while maintaining the excellent brown discoloration inhibiting effect, whereby an image of high density can be provided.

In the embodiment of (1), the amount of the aluminum oxide contained in the coated layer may preferably comprise 10 to 80% by weight of the total pigment, more preferably 25 to 65%. At a level less than 10%, the effect is not sufficient as compared with the case when no aluminum oxide is contained, while at a level exceeding 80%, the ink absorptivity of the coated layer will be undesirably lowered to great extent. Although the mechanism how the aluminum oxide inhibits indoor discoloration of the dye in the coated layer to exhibit the effect of enhancing dye color forming characteristic is not clear, according to the knowledge of the present inventors, it may be considered that incorporation of aluminum oxide may result in improvement of dye trappability in the coated layer to trap the dye in the ink, which is attached on the surface, at nearer to the surface without penetration into the inner portion, because of its strong dye absorptivity owing to having a positive surface potential in spite of relative lower specific surface area.

The aluminum oxide as herein mentioned may be obtained industrially by calcining aluminum hydroxide obtained by arc discharging of metallic aluminum pellets in pure water, or obtained by hot caustic soda treatment of bauxite which is a naturally occurring mineral. The method for preparation thereof is known per se, and various products having various crystal types ($\alpha$form, $\gamma$form, $\delta$form, $\eta$form, $\theta$form) and various particle sizes, bulk densities, specific surface areas are commercially available, and the present invention is inclusive of all of these.

For example, there can be used any of alumina powder, molten alumina, spherical alumina particles or $\alpha$-alumina, $\gamma$-alumina which are materials for ceramics, porcelains, grinding agents, etc., and otherwise ultrafine particulate alumina by the gas phase method (produced by Aerosil), active alumina for use in catalyst or adsorbent (produced by Iwantani Sangyo), colloidal aqueous dispersion of alumina hydrate (Alumina: produced by Nissan Kagaku), etc.

Although a composite of alumina and silica (activated clay, etc.) may be available as aluminum oxide, double salts of alumina containing basic oxides such as MgO, CaO, ZnO, CuO, NiO, MnO, $Fe_2O_3$, etc. cannot be used, because the color forming characteristic of the dye is undersirably lowered.

The alumina oxide to be used in the present invention has more preferably physical properties of a particle size ranging from 0.001 $\mu$m to $\mu$m and a specific surface area ranging from 1 to 500 $m^2/g$, more preferably 10 to 200 $m^2/g$. If the particle size is too small, powder drop-off will occur at the coated layer, while the dot shape will be worsened if it is too large. On the other hand, with a specific surface area less than 1 $m^2/g$, ink absorptivity will be remarkably lowered, while if it is over 500 $m^2/g$, indoor discoloration cannot be improved even when the alumina oxide is combined with the above silicon-containing pigment.

Examples of the binder to be used in the embodiment (1) may include water-soluble polymers such as polyvinyl alcohol, starch, oxidized starch, cationized starch, casein, carboxymethyl cellulose, gelatin, hydroxyethyl cellulose, etc. and water-dispersed type polymers such as SBR latex, MBR latex, vinyl acetate emulsion, acrylic type emulsion, etc., which may be used either singly or as a mixture of two or more kinds.

In the present invention, the coated layer is formed by use of a coating liquid with a suitable concentration and viscosity by mixing the materials as described above.

The coating amount of the aqueous coating liquid may be suitably in the range of 2 to 50 $g/m^2$ on drying. If it is less than 2 $g/m^2$, the ink absorptivity of the coated layer is lowered, and there is the problem of feathering such that the ink is blurred along the fibers exposed on the surface. When it exceeds 50 $g/m^2$, the coated layer becomes fragile, resulting in the problem of powder drop-off.

As a modification example of the embodiment (1), there is the embodiment (2) in which a layer containing the silicon-containing pigment (a) or (b) as mentioned above is made an upper layer, and a layer containing a pigment with a particle size than the silicon-containing pigment is made an under layer.

In the present invention, by forming the under layer with a pigment having greater particle size and embedding the fine uneveness of the surface of the under layer with the pigment having smaller particle size in the upper layer, the advantage in using a pigment with greater particle size is utilized to give an image without occurrence of powder drop-off, and further with good dot shape and without a feeling of roughness.

The specific surface area of the pigment for forming the under layer should preferably be not less than that of the pigment for forming primarily the upper layer, more preferably 200 $m^2/g$ or higher, also in aspect of ink absorptivity. According to the knowledge of the present inventors, so long as the dye in the ink droplets is trapped in the upper layer, the specific surface area of the pigment for forming the under layer will contribute little to indoor discoloration.

With respect to color forming characteristic and ink absorptivity, the construction such that the ink absorptivity of the upper layer is so slow as to cause feathering of the ink droplets attached on the surface to appropriate sizes and such that the ink absorptivity of the under layer is great is preferred, and for this purpose the ratio of the pigment to the binder in the upper layer is preferably in the range of 1/3 to 5/1, more preferably 1/2–3/1, and such ratio in the coated layer as a whole is preferably in the range of 1/1 to 10/1.

Since the ink receiving layer is constituted of the two layers as described above, the coated amount of the upper layer may be preferably 1 to 20 $g/m^2$, more preferably 5 to 15 $g/m^2$, and that of the under layer is preferably greater than that of the upper layer within the range such that the total coated amount in the ink receiving layer may be 2 to 50 g/m$^2$, preferably 8 to 30 g/m$^2$.

If the amount of the upper layer is less than 1 g/m$^2$, there is no noticeable effect as compared with the case that no upper layer is provided, while with an amount over 20 g/m$^2$, the effect of the under layer cannot be exhibited, whereby ink absorption speed, dye color forming characteristic, indoor discoloration, etc. will be lowered.

In addition, in order to further improve ink absorptivity of the recording medium, there can preferably be used, as a pigment for forming an under layer, porous silica particles in the form of a spherical particulate shape as disclosed in Japanese Laid-Open Patent Application No. 183382/1987.

In particular, when spherical silica having a particle size of 10 to 30 μm is used for formation of an under layer, there can be provided a coated layer which has a large amount of void and excellent ink-absorptivity, as compared with that using a conventional amorphous silica.

When such particles are used for formation of a coated layer being a monolayer, there have been posed the problems that dots obtained get to be in the form of star shapes, that high adhesive strength can be obtained with difficulty, that powder drop-off occurs with ease, and that images obtained become rough.

Concerning specific metal compounds characterized in the embodiment (3), as the metal soap, there may be included the reaction products with stearic acid, lauric acid or other fatty acids or aromatic acids: as the salt, chlorides, sulfates, nitrates, ammonium salts, acetates, carbonates, oxalates, silicates, etc. thereof, Also, double salts of the above metals and those having crystal water may be also included. As the metal, above all, Ca, Mg, Al and Zn are preferred with respect to bonding force with silica, absence of toxicity and non-coloring property, etc.

The metal compound to be used in the present invention may be used either singly or a combination of two or more kinds, preferably in an amount of 0.1 to 30 parts by weight, particularly 0.5 to 20 parts by weight, per 100 parts by weight of silica. If the amount used is less than 0.1 part by weight, the advantageous effect of the present invention is insufficient, while if it is more than 30 parts by weight, undesirable results will occur such as lowering in ink absorptivity of the recording medium or lowering in color characteristic.

As the method for treating silica with the above metal compound, there may be employed preferably a dry process and a wet process. The dry process is a method in which the metal compound is attached uniformly onto silica by mixing silica with the metal compound, or by adding the powder of the metal compound, its aqueous solution or dispersion, to silica under stirring by spraying method, etc.

On the other hand, the wet process is a method in which silica is dipped in a treating liquid containing the metal compound during the steps of producing silica, in which gellation, aging and precipitation are conducted with the metal compound being added to the silica dispersion, in which the metal compound is added at the initial state of reaction, or in which the surface is treated by spraying the metal compound during the drying step. Among them, particularly preferred is the method in which the metal compound is added at the initial or later stage of the aging reaction or gellation or the method in which it is added at the initial stage of the reaction, whereby the silica surface can be covered with good efficiency.

The above methods are not limited, but any method may be employed, provided that silica can be previously treated on the surface thereof with the metal compound prior to inclusion in the coated layer.

As the silica before treatment to be used in the recording medium of the present invention, any of natural or synthetic silica may be available, but particularly preferable is synthetic fine particulate silica with a specific surface area having preferably 200 to 700 g/m$^2$ according to the BET method, and by use of the silica with such specific surface area, excellent color forming characteristic of the water-soluble dye in ink, optimum shape and size of ink dots can be accomplished.

As the silicon-containing type pigment before thermal treatment to be used in (4), any of natural or synthetic silica may be available, but particularly preferable is synthetic fine particulate silica with a specific surface area of preferably 200 to 700 g/m$^2$ according to the BET method. By use of the silica with such specific surface area, excellent color forming characteristic of the water-soluble dye in ink, optimum shape and size of ink dots can be accomplished.

The silica to be used in the present invention is a silica obtained by subjecting the silica as mentioned above to thermal treatment at a temperature of 400° C. or higher, preferably 600° C. to 1200° C., further preferably for about 10 minutes to about 10 hours, and by thermal treatment of the silica under the above conditions. The problem of the prior art, which occurred when silica is included in the recording medium, namely the problem of indoor discoloration and discoloration to yellow of the recorded image, has been solved, while retaining the advantage possessed by silica such as excellent color forming characteristic, etc. There is also an example in which a silica treated with a silane coupling agent, etc. is used, but such silica is made remarkably hydrophobic on its surface, thereby involving problems such as difficult preparation of a coating liquid, and lowering in coating workability. However, in the present invention, there is no such problem as mentioned above, since the surface of the silica particles is not made hydrophobic.

In any of the above embodiments (1) to (4), after coating with an aqueous coating liquid comprising a pigment and a binder, drying is performed by drying methods known in the art, for example, by use of a hot air drying furnace, a hot drum, etc. to give the recording medium of the present invention.

Also, for smoothening the coated layer surface, or for enhancing the surface strength of the coated layer, super calendering may be also used in the steps.

Further, in the present invention, the coated layer may also contain dye fixing agents (water-resistant agents), fluorescent whitener, surfactants, deforming agents, pH controllers, antifungal agents, UV-absorbers, antioxidants, etc.

Particularly, an antioxidant known in the art such as thioether tends to inhibit indoor discoloration, and even when it is provided in the coated layer, discoloration to yellow will not occur. Thus it may be provided in the range such that the coated layer is not colored or the coated layer strength is not lowered.

According to the knowledge of the present inventors, particularly when a polycationic substance is provided as the dye fixing agent, water resistance of the recorded image can be strengthened simultaneously with exhibition of the effect to inhibit indoor discoloration, and therefore it may be more preferably contained in the coated layer.

As such cationic substance, any of water-resistant agents for paper for ink jet known in the art having quaterarized amine within the structure may be available. Such water-resistant agent (dye fixing agent) may be desirably used in an amount of about 0.5 to 15% by weight based on the pigment. It is not preferable to contain 15% or more by weight thereof, because light resistance will be remarkably lowered, although there might be the effect against indoor discoloration of the image.

According to the recording method in which recording is performed with multi-color aqueous inks of, for example, yellow (Y), magenta (M), cyan (C), black (Bk), etc., by use of the ink jet recording system on the recording medium with the construction as described above, the image obtained is free from indoor discoloration and a recorded image with excellent storability can be obtained.

The recording medium of the present invention contains a large amount of a pigment with high dye trapping ability in its surface layer, and therefore the probability that the dye in the ink droplets is trapped and absorbed by the pigment is high, whereby feathering or diffusion of ink can be inhibited, with the result that the dot shape can be improved to exhibit excellent ink absorptivity, resolution, color forming characteristic, and color forming density.

Further, the present invention exhibits the ink jet recording adaptability for the coated paper as above, particularly excellent image density, and has few problems of image storability inherent in the coated paper and of discoloration to yellow upon storing the paper in a file or a binder. Thus, in the recording method according to the ink jet recording system by use of the recording medium of the present invention and multi-color inks, the obtained image can be stored on the wall or in a drawer in an office which is not directly irradiated with sunlight for one to several months without the problem of indoor discoloration, or the problem of coloration (discoloration to yellow) of a white portion of the coated paper or the recorded image during storage thereof in a file or a binder made of polyethylene, polypropylene, etc., for one to several months.

The present invention is described below in more detail by referring to Examples and Comparative examples. In the sentences, parts and % are based on weight, unless otherwise particularly noted.

EXAMPLES 1-8 AND COMPARATIVE EXAMPLES 1-4

Pure papers with a basis weight of 100 g/m$^2$ and a sizing degree of 22 sec. as a substrate were coated with coating compositions shown below to a coated amount on drying of 20 g/m$^2$ by the bar coater method, followed by hot air drying at 110° C. for 5 minutes to obtain recording media of the present invention and recording media for comparative purposes.

| (Coating liquid composition) | |
|---|---|
| Pigment | 25 parts |
| Polyvinyl alcohol (PVA, produced by Kuraray) | 5 parts |
| Cation-modified polyvinyl alcohol (PVA-C-118-2A, produced by Kuraray) | 5 parts |
| Polyamine type water-resistant agent (Polyfix 601, produced by Showa Kobunshi) (60% aqueous solution) | 3 parts |
| Fluorescent whitener (Kaycoll BRAL produced by Shinnisso Kako) | 0.3 parts |
| Water | 200 parts |

As the pigments in the above coating liquid compositions, those shown below in Table 1 were employed.

TABLE 1

| | Pigment | Parts | Specific Surface Area (m$^2$/g) |
|---|---|---|---|
| Example | | | |
| 1 | Finesil SP-20 (Tokuyama Soda)*1 | 16 | 18 |
| | Aerosil aluminum oxide-C (Nippon Aerosil)*2 | 9 | 100 |
| 2 | Finesil SP-20 (the same as above) | 16 | |
| | Active alumina 2R-30 (Iwatani Kagaku Kogyo) | 9 | 48 |
| 3 | Finesil SP-20 (the same as above) | 7 | |
| | Alumina sol 520 (Nissan Kagaku)*3 | 17 | 300 |
| 4 | Mizukanite P-1 (Mizusawa Kagaku)*4 | 16 | 600 |
| | Activated clay (Tsuchiya Kaonlin Kogyo) | 9 | |
| 5 | Mizukanite P-1 (the same as above) | 20 | |
| | Active alumina 2R-30 (the same as above) | 5 | |
| 6 | Mizukanite P-1 (the same as above) | 16 | |
| | Alumina spherical particles AX-10 (Micron) | 9 | 1 or less |
| 7 | Tokusil CM (Tokuyama Soda)*1 | 16 | 80 |
| | Aerosil aluminum oxide-C (the same as above) | 9 | |
| 8 | Mizukasil P-527 (Mizusawa Kagaku)*5 | 16 | 40 |
| | Activated clay (the same as above) | 9 | 10 or less |
| Comparative example | | | |
| 1 | Siloid 620 (Fuji Davidson)*1 | 25 | 300 |
| 2 | Mizukasil P-78D (Mizusawa Kagaku)*1 | 25 | 384 |
| 3 | Finesil X-37(b) (Tokuyama Soda)*1 | 16 | 360 |
| | Active alumina RK-30 | 9 | 282 |
| 4 | Nipsil HD-2 (Nippon Silica Kogyo)*5 | 16 | 264 |

TABLE 1-continued

| Pigment | Parts | Specific Surface Area ($m^2/g$) |
|---|---|---|
| Aerosil aluminum oxide C | 9 | |

Note
*1: fine powdery silicic acid;
*2: ultrafine particulate alumina;
*3: 20% colloidal dispersion of alumina hydrate;
*4: synthetic silicate mineral;
*5: fine powdery silica.

COMPARATIVE EXAMPLES 5 AND 6

A commercially available coated paper NM for ink jet (produced by Mitsubishi Paper Mills, Ltd.) (Comparative example 5) and FC-9 (produced by Jujo Paper Mfg. Co., Ltd.) (Comparative example 6) were employed as the recording media for comparative purposes.

Ink jet recording adaptability of the above recording media was evaluated by performing ink jet recording with an ink having the composition shown below by use of (a) an ink jet printer having ink jet heads each equipped with 128 nozzles at nozzle intervals of 16 nozzles/1 mm for four colors of Y, M, C and Bk and (b) an ink jet printer having 24 nozzles at intervals of 8 nozzles/1 mm for the four colors.

Ink composition (I)

| | |
|---|---|
| Dye | 3 parts |
| Diethylene glycol | 20 parts |
| Water | 7 parts |
| Dye (ink I) | |
| Y: C.I. Direct Yellow 86 | |
| M: C.I. Acid Red 35 | |
| C: C.I. Direct Blue 199 | |
| Bk: C.I. Direct Black 17 | |

Ink composition (II)

| | |
|---|---|
| Dye | 2 parts |
| Polyethylene glycol | 20 parts |
| Polyethylene glycol #200 | 15 parts |
| Water | 63 parts |
| Dye (ink II) | |
| Y: C.I. Acid Yellow 42 | |
| M: C.I. Acid Red 92 | |
| C: C.I. Direct Blue 86 | |
| Bk: C.I. Direct Black 51 | |

Ink composition (III)

C.I. acid black 26 was used as the dye in the ink composition (II).

Evaluation was performed with respect to the following items. The results are shown below in Table 2.

Measurement and evaluation methods (1) Discoloration ΔE*ab of Food Black 2 by the ozone test was measured according to the method as described above.

(2) For measurement of indoor storability (1), a color image was formed by use of the ink (I), (II) and the printer (a), attached on the wall in an office and left to stand for 6 months. The image with no discoloration recognized as compared with the same image stored similarly in a clear pocket file for 6 months was rated as o, that with excessive discoloration as x, and that with medium discoloration therebetween as Δ.

(3) For measurement of indoor storability (2), a solid pattern of Bk was printed by use of the ink (III) and the printer (b), attached similarly on the wall in an office as in (2) and left to stand for one month. The difference ΔE*ab between the chromaticity of this image and the chromaticity of the image immediately after printing was determined for evaluation of indoor discoloration.

(4) For color characteristic, chroma of the printed matter by solid printing (Y, M, C) with the use of the ink (I) and the printer (a) was measured by use of a high speed color analyzer CA-35 (produced by Murakami Shikisai Kagaku).

(5) For image density, O.D of the printed matter with solid printing with the use of the ink (III) and the printer (a) was measured by use of Macbeth Densitometer RD-914.

(6) For evaluation of discoloration to yellow, the following test was done. Recording mediums were stored in a clear pocket file (produced by Lion) for 6 months in a dark place. Thereafter, the recording medium with no discoloration to yellow at its coated surface was ranked as o, and that with discoloration to yellow was ranked as x.

TABLE 2

| | Example | | | | | | | |
|---|---|---|---|---|---|---|---|---|
| | 1 | 2 | 3 | 4 | 5 | 6 | 7 | 8 |
| ΔE*ab | 2.9 | 4.7 | 6.3 | 5.6 | 7.8 | 3.4 | 10.3 | 5.1 |
| Indoor storability (1) | | | | | | | | |
| (I) | ○ | ○ | ○ | ○ | ○ | ○ | ○ | ○ |
| (II) | ○ | ○ | ○ | ○ | ○ | ○ | ○ | ○ |
| Indoor storability (2) | 1.7 | 2.8 | 3.6 | 3.8 | 4.1 | 1.8 | 7.3 | 3.6 |
| Color characteristic | | | | | | | | |
| Y | 81.5 | 83.9 | 78.3 | 80.2 | 85.6 | 77.1 | 81.0 | 80.3 |
| M | 70.4 | 74.0 | 70.6 | 71.1 | 74.2 | 66.3 | 70.4 | 69.4 |
| C | 58.8 | 50.1 | 57.0 | 59.2 | 59.7 | 54.5 | 56.7 | 59.1 |
| Image density | 0.72 | 0.76 | 0.83 | 0.71 | 0.84 | 0.70 | 0.83 | 0.75 |

TABLE 2-continued

| | | | | | | | | |
|---|---|---|---|---|---|---|---|---|
| Bk Discoloration to yellow | ○ | ○ | ○ | ○ | ○ | ○ | ○ | ○ |

| | Comparative example | | | | | |
|---|---|---|---|---|---|---|
| | 1 | 2 | 3 | 4 | 5 | 6 |
| ΔE*ab | 28.0 | 26.7 | 25.2 | 23.5 | 32.0 | 34.0 |
| Indoor storability (1) | | | | | | |
| (I) | X | X | X | X | X | X |
| (II) | X | X | X | X | X | X |
| Indoor storability (2) | 17.6 | 14.3 | 15.2 | 15.7 | 21.0 | 20.0 |
| Color characteristic | | | | | | |
| Y | 80.8 | 82.7 | 80.4 | 82.3 | — | — |
| M | 67.7 | 73.6 | 69.8 | 71.4 | — | — |
| C | 56.7 | 59.1 | 59.7 | 60.0 | — | — |
| Image density | 0.79 | 0.77 | 0.76 | 0.75 | — | — |
| Bk Discoloration to yellow | X | X | X | X | X | X |

EXAMPLES 9–14, COMPARATIVE EXAMPLES 7–9

A pure paper with a basis weight of 100 g/m$^2$ and a sizing degree of 22 sec. as the substrate was coated with a coating composition shown below to a coated amount on drying of 15 g/m$^2$ by the bar coater method, followed by hot air drying at 110° C. for 5 minutes, to form an under layer.

| | |
|---|---|
| Pigment | 24 parts |
| Polyvinyl alcohol (PVA-117, produced by Kuraray) | 4 parts |
| Polyvinyl alcohol (PVA-105, produced by Kuraray) | 4 parts |
| Water | 200 parts |

The under layer thus formed was coated with a coating composition shown below to a coated amount on drying of 8 g/m$^2$ by the bar coater method, followed by drying at 110° C. for 5 minutes, to form a upper layer to obtain the recording medium of the present invention and the recording medium for comparative purpose.

| | |
|---|---|
| Pigment | 25 parts |
| Polyvinyl alcohol (PVA-117, produced by Kuraray) | 6 parts |
| Polyvinyl alcohol (PVA-105, produced by Kuraray) | 6 parts |
| Polyamine type water-resistant agent (28% aqueous solution) (PASH-10L, produced by Nittobo) | 4 parts |
| Water | 200 parts |

The pigments used for formation of the upper layer in Examples 9–14 and Comparative examples 7–9 are shown in Table 3.

TABLE 3

| | Pigment (Manufacturer) | Average particle size (μm) | Specific surface area (m$^2$/g) | Parts used |
|---|---|---|---|---|
| (Upper layer) Example 9 | Finesil SP-20 (Tokuyama Soda) | 9.1 | 18 | 13 |
| | Spherical alumina AX-O (produced by Micron) | 3.0 | 0.5 | 12 |
| 10 | Mizukasil P-527 (Mizusawa Kagaku) | 2.9 | 40 | 16 |
| | Aerosil aluminum oxide-C | 0.02 | 100 | 9 |
| 11 | Kyoward 600 (Kyowa Kagaku) 1 | 5.4 | 30 | 13 |
| | Active alumina RG-30 (Iwatani Kagaku Kogyo) | 0.5 | 48 | 12 |
| 12 | Nipsil E-150J (Nippon Silica Kogyo) | 4.2 | 95 | 7 |
| | Alumina sol 520 (Nissan Kagaku) | 0.1 or less | 300 | 18 |
| 13 | Finesil SP-20 | 9.1 | 18 | 16 |
| | Aerosil aluminum oxide-C | 0.02 | 100 | 9 |
| 14 | Finesil SP-20 | 9.1 | 18 | 13 |
| | Aerosil aluminum oxide-C | 0.02 | 100 | 12 |
| (Under layer) Examples 9–11 | Sailoid 620 (Fuji Davidson) | 12.0 | 300 | 24 |
| 12–14 | Spherical Silica (Asahi Grass) | 15.0 | 700 | 24 |
| (Upper layer) Comparative Example 7 | Sailoid 72 (Fuji Davidson) | 2.5 | 300 | 25 |
| 8 | Finesil X-37 (B) (Tokuyama Soda) | 3.7 | 260 | 25 |
| 9 | Nipsil HD-2 (Nippon Silica Kogyo) | 3.2 | 264 | 13 |
| | Aerosil aluminum oxide-C | 0.02 | 100 | 12 |
| (Under layer) Comparative Examples 7–9 | Sailoid 620 (Fuji Davidson) | 12.0 | 300 | 24 |

1 Magnesium silicate
2 Synthetic silicate mineral: the colorants other than alumina are all silica.

For each of the above recording media, recording was performed and evaluated in the same manner as in Example 1. The results are shown in Table 4.

TABLE 4

| | Ink absorp-tivity | Indoor storability (I) | Indoor storability (II) | Indoor storability ΔE*ab | Color characteristic Y | M | C | Image density Bk | Ozone test ΔE*ab |
|---|---|---|---|---|---|---|---|---|---|
| Example | | | | | | | | | |
| 9 | ○ | ○ | ○ | 5.2 | 86.7 | 74.2 | 53.2 | 0.75 | 6.4 |
| 10 | ○ | ○ | ○ | 2.3 | 87.3 | 74.2 | 51.9 | 0.82 | 2.9 |
| 11 | Δ | ○ | Δ | 7.8 | 87.8 | 75.7 | 54.2 | 0.81 | 11.2 |
| 12 | ○ | ○ | ○ | 5.6 | 76.4 | 68.1 | 51.9 | 0.88 | 8.9 |
| 13 | ○ | ○ | ○ | 2.1 | 75.0 | 64.8 | 48.2 | 0.71 | 2.2 |
| 14 | ○ | ○ | ○ | 2.4 | 87.1 | 74.4 | 51.1 | 0.82 | 2.9 |
| Comparative | | | | | | | | | |
| 7 | ○ | X | X | 21.6 | 88.7 | 75.9 | 56.0 | 0.75 | 29.3 |
| 8 | ○ | X | X | 21.2 | 83.9 | 74.3 | 55.2 | 0.73 | 27.8 |
| 9 | ○ | X | X | 21.4 | 93.0 | 75.8 | 56.0 | 0.89 | 29.2 |

EXAMPLES 15–19

As shown below in Remarks, a variety of silica to be used in the present invention were prepared.

Next, by use of silica shown in Remarks respectively, the coating liquids with the compositions shown below were prepared.

Next, pure paper in general (Ginkan; basis weight 64 g/m$^2$, produced by Sanyo Kokusaku Pulp K.K.) were coated with the respective coated liquids by bar coater at a coated amount on drying of 12 g/m$^2$, followed by drying in a conventional manner to obtain recording media of the present invention.

| | |
|---|---|
| Silica in Remarks | 100 parts |
| Polyvinyl alcohol (PVA 117, produced by Kuraray) | 70 parts |
| Water | 100 parts |

COMPARATIVE EXAMPLE 10

For comparison, in place of the surface treated silica B in Example 15, an untreated silica A was used, following otherwise the same procedure as in Example 15, to prepare a recording medium of comparative example.

COMPARATIVE EXAMPLE 11

For comparison, in place of the surface treated silica B in Example 15, a coating solution was prepared by merely blending the silica A and calcium chloride which is the treating agent compound at normal temperature during preparation of the coating liquid, following otherwise the same procedure as in Example 15, to prepare a recording medium of comparative example.

Remarks (Examples 15–19, Comparative examples 10, 11)

EXAMPLE 15

Silica B: Immediately after aging for 40 minutes in the reaction of silica A as described below, 5% of magnesium chloride was added based on silica, followed further by aging for 20 minutes, and otherwise the same procedure as for silica A was repeated to obtain silica B.

EXAMPLE 16

Silica C: Immediately before drying by spray dryer in the reaction of silica A as described below, 10% of aluminum hydroxide was added based on silica, and otherwise the same procedure as for silica A was repeated to obtain silica C.

EXAMPLE 17

Silica D: Immediately after alkali neutralization in the reaction of silica A as described below, 6% of zinc oxide was added based on silica, and otherwise the same procedure as for silica A was repeated to obtain silica D.

EXAMPLE 18

Silica E: During drying by spray dryer in the reaction of silica A as described below, 15% of magnesium laurate was added based on silica, and otherwise the same procedure as for silica A was repeated to obtain silica E.

EXAMPLE 19

Silica F: Silica A as described below was subjected to thermal treatment at 700° C. for one hour to obtain silica F.

COMPARATIVE EXAMPLE 10

Silica A: Into a reactor were charged 10 m$^3$ of commercially available sodium silicate and 35 m$^3$ of water, and under stirring of the mixture, 3.2 m$^2$ of sulfuric acid (220 g/ml) was added over about 15 minutes. Under stirring of this liquid, steam was blown there into to elevate the temperature within 60 minutes to 90° C. Then, aging was effected at the same temperature for 40 minutes, and the alkali was neutralized with sulfuric acid to complete the reaction. Next, the solution was filtered, washed with water and pulverized after drying by a spray dryer to obtain silica A with a specific surface area of 350 g/m$^2$.

COMPARATIVE EXAMPLE 11

Silica A

Treating method: no treatment (during preparation of coating solution, 3% of calcium chloride was merely mixed with silica).

For the above recording media, recording was performed and evaluated in the same manner as in Example 1. The results are shown in Table 5.

TABLE 5

| | Example | | | | | Comparative example | |
|---|---|---|---|---|---|---|---|
| | 15 | 16 | 17 | 18 | 19 | 10 | 11 |
| ΔE*ab | 15.2 | 16.1 | 16.2 | 14.2 | 17.6 | 25.6 | 23.1 |
| Indoor storability (1) | | | | | | | |
| (I) | ○ | ○ | ○ | ○ | ○ | X | Δ |
| (II) | Δ | Δ | Δ | Δ | Δ | X | X |
| Indoor storability (2) | 9.7 | 10.1 | 11.1 | 9.2 | 10.5 | 20.3 | 17.2 |
| Color characteristic | | | | | | | |
| Y | 82.3 | 84.6 | 80.3 | 82.1 | 83.9 | 84.2 | 81.7 |
| M | 70.3 | 72.0 | 70.1 | 71.0 | 71.5 | 71.6 | 70.0 |
| C | 51.0 | 51.8 | 51.6 | 50.8 | 52.0 | 52.2 | 51.3 |
| Image density Bk | 0.71 | 0.73 | 0.69 | 0.70 | 0.72 | 0.73 | 0.71 |
| Discoloration to yellow | ○ | ○ | ○ | ○ | ○ | X | X |

What is claimed is:

1. A recording medium, comprising a substrate and an ink receiving layer containing (i) a silicon-containing pigment with a specific surface area in the range of 10 to 100 $m^2/g$, (ii) aluminum oxide particles, and (iii) a binder provided on said substrate, wherein the recording medium exhibits discoloration ΔE*ab of C.I. Food Black 2 of 20 or less according to the ozone test, and wherein the amount of aluminum oxide particles is in the range of 10 to 80% by weight with respect to the total pigment contained in the ink receiving layer.

2. A recording medium according to claim 1, wherein the ink-receiving layer is porous.

3. A recording medium according to claim 1, wherein the discoloration ΔE*ab of C.I. Food Black 2 according to the ozone test is 10 or less.

4. A recording medium according to claim 1, wherein the aluminum oxide particles have a specific surface area in the range of 1 to 500 $m^2/g$.

5. A recording medium according to claim 3, wherein the aluminum oxide particles have a specific surface area in the range of 10 to 200 $m^2/g$.

6. A recording medium according to claim 1, wherein the aluminum oxide particles have particle sizes in the range of 0.001 to 10 μm.

7. A recording medium, comprising a substrate and an ink-receiving layer comprising (i) an upper layer containing a silicon-containing pigment with a specific surface area in the range of 10 to 100 $m^2/g$, aluminum oxide and a binder, and (ii) an under layer containing a pigment with greater particle size than the above pigment, wherein the recording medium exhibits discoloration ΔE*ab of C.I. Food Black 2 of 20 or less according to the ozone test.

8. A recording medium according to claim 7, wherein the pigment contained in the under layer is spherical silica.

9. A recording medium according to claim 7, wherein the discoloration ΔE*ab of C.I. Food Black 2 according to the ozone test is 10 or less.

10. A recording medium according to claim 7, wherein the aluminum oxide particles have a specific surface area in the range of 1 to 500 $m^2/g$.

11. A recording medium according to claim 10, wherein the alumium oxide particles have a specific surface area in the range of 10 to 200 $m^2/g$.

12. A recording medium according to claim 7, wherein the pigment contained in the under layer has a specific surface area of 200 $m^2/g$ or higher.

13. A recording medium according to claim 12, wherein the pigment has a specific surface area of 200 to 700 $m^2/g$.

14. A recording medium according to claim 7, wherein the ratio of the pigment to the binder used in the upper layer is in the range of 1/3 to 5/1 in terms of weight ratio.

15. A recording medium according to claim 14, wherein the ratio is in the range of 1/2 to 3/1.

16. A recording medium according to claim 7, wherein the ratio of the pigment to the binder used in the ink-receiving layer is 1/1 to 10/1 in terms of weight ratio.

17. A recording medium according to claim 7, wherein the coated amount of the upper layer is in the range of 1 to 20 $g/m^2$.

18. A recording medium according to claim 7, wherein the coated amount of the lower layer is larger than that of the upper layer.

19. A recording medium, comprising a substrate and an ink-receiving layer comprising (1) an upper layer containing a silicon-containing pigment with a pH value of at least 8, and wherein said silicon-containing pigment (i) has incorporated in its structure a basic oxide of metals selected from the group consisting of Ca, Mg, Al, Zn, Ba, Sr and Sn or (ii) is surface treated with at least one of a salt and an oxide of metals selected from the group consisting of Ca, Mg, Al, Zn, Ba, Sr and Sn, said upper layer further containing aluminum oxide and a binder, and (2) an under layer containing a pigment with greater particle size than the above pigment, wherein the recording medium exhibits discoloration ΔE*ab of C.I. Food Black 2 of 20 or less according to the ozone test.

20. A recording medium according to claim 19, wherein the pigment contained in the under layer is spherical silica.

21. A recording medium according to claim 19, wherein the discoloration ΔE*ab of C.I. Food Black 2 according to the ozone test is 10 or less.

22. A recording medium according to claim 19, wherein the aluminum oxide particles have a specific surface area in the range of 1 to 500 $m^2/g$.

23. A recording medium according to claim 13, wherein the aluminum oxide particles have a specific surface area in the range of 10 to 200 $m^2/g$.

24. A recording medium according to claim 19, wherein the pigment contained in the under layer has a specific surface area of 200 $m^2/g$ or higher.

25. A recording medium according to claim 24, wherein the pigment has a specific surface area of 200 to 700 $m^2/g$.

26. A recording medium according to claim 19, wherein the ratio of the pigment to the binder used in the upper layer is in the range of $\frac{1}{3}$ to 5/1 in terms of weight ratio.

27. A recording medium according to claim 26, wherein the ratio is in the range of $\frac{1}{2}$ to 3/1.

28. A recording medium according to claim 19, wherein the ratio of the pigment to the binder used in the ink-receiving layer is 1/1 to 10/1 in terms of weight ratio.

29. A recording medium according to claim 19, wherein the coated amount of the upper layer is in the range of 1 to 20 $g/m^2$.

30. A recording medium according to claim 19, wherein the coated amount of the lower layer is larger than that of the upper layer.

31. A recording medium, comprising a substrate and an ink receiving layer containing (1) a silicon-containing pigment with a pH value of at least 8, and wherein said silicon-containing pigment (i) has incorporated in its structure a basic oxide of metals selected from the group consisting of Ca, Mg, Al, Zn, Ba, Sr and Sn or (ii) is surface treated with at least one of a salt and an oxide of metals selected from the group consisting of Ca, Mg, Al, Zn, Ba, Sr and Sn, (2) aluminum oxide particles, and (3) a binder provided on said substrate, wherein the recording medium exhibits discoloration $\Delta E^*ab$ of C.I. Food Black 2 of 20 or less according to the ozone test, and wherein the amount of aluminum oxide particles is in the range of 10 to 80% by weight with respect to the total pigment contained in the ink receiving layer.

32. A recording medium according to claim 31, wherein the ink-receiving layer is porous.

33. A recording medium according to claim 31, wherein the discoloration of $\Delta E^*ab$ of C.I. Food Black 2 according to the ozone test is 10 or less.

34. A recording medium according to claim 31, wherein the aluminum oxide particles have a specific surface area in the range of 1 to 500 $m^2/g$.

35. A recording medium according to claim 34, wherein the aluminum oxide particles have a specific surface area in the range of 10 to 200 $m^2/g$.

36. A recording medium according to claim 31, wherein the aluminum oxide particles have particle sizes in the range of 0.001 to 10 $\mu m$.

37. An ink jet recording method in which recording is performed, using at least one of a yellow ink, a magenta ink, a cyan ink, and a black ink, on a recording medium comprising a substrate and an ink receiving layer containing (i) a silicon-containing pigment with a specific surface area in the range of 10 to 100 $m^2/g$, (ii) aluminum oxide particles, and (iii) a binder provided on said substrate, wherein the recording medium exhibits discoloration $\Delta E^*ab$ of C.I. Food Black 2 of 20 or less according to the ozone test, and wherein the amount of aluminum oxide particles is in the range of 10 to 80% by weight with respect to the total pigment contained in the ink receiving layer.

38. An ink jet recording method in which recording is performed, using at least one of a yellow ink, a magenta ink, a cyan ink, and a black ink, on a recording medium comprising a substrate and an ink-receiving layer comprising (i) an upper layer containing a silicon-containing pigment with a specific surface area in the range of 10 to 100 $m^2/g$, aluminum oxide and a binder, and (ii) an under layer containing a pigment with greater particle size than the above pigment, wherein the recording medium exhibits discoloration $\Delta E^*ab$ of C.I. Food Black 2 of 20 or less according to the ozone test.

39. An ink jet recording method in which recording is performed, using at least one of a yellow ink, a magenta ink, a cyan ink, and a black ink, on a recording medium comprising a substrate and an ink-receiving layer comprising (1) an upper layer containing a silicon-containing pigment with a pH value of at least 8, and wherein said silicon-containing pigment (i) has incorporated in its structure a basic oxide of metals selected from the group consisting of Ca, Mg, Al, Zn, Ba, Sr and Sn or (ii) is surface treated with at least one of a salt and an oxide of metals selected from the group consisting of Ca, Mg, Al, Zn, Ba, Sr and Sn, said upper layer further containing aluminum oxide and a binder, and (2) an under layer containing a pigment with greater particle size than the above pigment, wherein the recording medium exhibits discoloration $\Delta E^*ab$ of C.I. Food Black 2 of 20 or less according to the ozone test.

40. An ink jet recording method in which recording is performed, using at least one of a yellow ink, a magenta ink, a cyan ink, and a black ink, on a recording medium comprising a substrate and an ink receiving layer containing (1) a silicon-containing pigment with a pH value of at least 8, and wherein said silicon-containing pigment (i) has incorporated in its structure a basic oxide of metals selected from the group consisting of Ca, Mg, Al, Zn, Ba, Sr and Sn or (ii) is surface treated with at least one of a salt and an oxide of metals selected from the group consisting of Ca, Mg, Al, Zn, Ba, Sr and Sn, (2) aluminum oxide particles, and (3) a binder provided on said substrate, wherein the recording medium exhibits discoloration $\Delta E^*ab$ of C.I. Food Black 2 of 20 or less according to the ozone test, and wherein the amount of aluminum oxide particles is in the range of 10 to 80% by weight with respect to the total pigment contained in the ink receiving layer.

* * * * *

UNITED STATES PATENT AND TRADEMARK OFFICE

CERTIFICATE OF CORRECTION

PATENT NO. 5,041,328 Page 1 of 2

DATED August 20, 1991

INVENTOR(S) Takashi Akiya, et al.

It is certified that error appears in the above-identified patent and that said Letters Patent is hereby corrected as shown below:

Title page:

[30] FOREIGN APPLICATION PRIORITY DATA:

"Apr. 10, 1987 [JP] Japan ... 62-8809" should read --Apr. 10, 1987 [JP] Japan ... 62-88096--.

[57] ABSTRACT:

Line 1,"and a" should read --and an--.

COLUMN 4:

Line 36, "as" should read --was--.
Line 58, "the" should be deleted.

COLUMN 5:

Line 28, "preferably" should read --preferable--.

COLUMN 9:

Line 7, "of" should be deleted.
Line 64, "undersirably" should read --undesirably--.
Line 65, "alumina" should read --aluminum--.

UNITED STATES PATENT AND TRADEMARK OFFICE

CERTIFICATE OF CORRECTION

PATENT NO. 5,041,328

DATED August 20, 1991

INVENTOR(S) Takashi Akiya, et al.

It is certified that error appears in the above-identified patent and that said Letters Patent is hereby corrected as shown below:

COLUMN 18:

Line 22, "a" should read --an--.

COLUMN 23:

Line 12, "⅓" should read --1/3--.
Line 15, "½" should read --1/2--.

Signed and Sealed this

Twelfth Day of May, 1992

*Attest:*

DOUGLAS B. COMER

*Attesting Officer*

*Acting Commissioner of Patents and Trademarks*